United States Patent [19]

Tarcisio

[11] Patent Number: 4,512,228

[45] Date of Patent: Apr. 23, 1985

[54] AUTOMATIC SAUSAGE SLICING MACHINE FOR SALAMI AND LIKE PRODUCTS

[75] Inventor: Re Tarcisio, Rho, Italy

[73] Assignee: Victor Slicing Systems S.r.l., Milan, Italy

[21] Appl. No.: 444,202

[22] Filed: Nov. 23, 1982

[30] Foreign Application Priority Data

Nov. 23, 1981 [IT] Italy ..... 25221 A/81

[51] Int. Cl.[3] ..... B26D 5/20; B26D 7/06

[52] U.S. Cl. ..... 83/355; 83/401; 83/403.1; 83/420; 83/422; 198/625; 198/663

[58] Field of Search ..... 83/401, 436, 403.1, 83/354–356.3, 420, 438, 444, 449, 422; 198/625, 663

[56] References Cited

U.S. PATENT DOCUMENTS

| | | | |
|---|---|---|---|
| 1,933,404 | 10/1933 | Allen et al. | 198/625 X |
| 1,976,826 | 10/1934 | Ahrndt | 83/355 X |
| 1,995,048 | 3/1935 | Walter | 83/436 X |
| 2,036,001 | 3/1936 | Walter | 83/436 X |
| 2,608,815 | 9/1952 | Graaff | 198/625 X |

FOREIGN PATENT DOCUMENTS

| | | | |
|---|---|---|---|
| 642158 | 1/1979 | U.S.S.R. | 83/436 |

*Primary Examiner*—James M. Meister

*Attorney, Agent, or Firm*—Birch, Stewart, Kolasch & Birch

[57] ABSTRACT

An automatic sausage slicing machine for salami and the like comprises a framework carrying an electric motor which drives an orbital blade and a feed device for continuously feeding a line of products to be sliced towards the path of displacement of the orbital blade. The feed device comprises a plurality of entrainment shafts located side by side and separated by longitudinal containment partitions, each entrainment shaft having a helical ridge on which a respective product to be cut rests in use, the product being inserted between a corresponding pair of containment partitions. A drive mechanism provided for simultaneously rotating the entrainment shafts in synchronism with the movement of the orbital blade.

13 Claims, 5 Drawing Figures

AUTOMATIC SAUSAGE SLICING MACHINE FOR SALAMI AND LIKE PRODUCTS

BACKGROUND OF THE INVENTION

The present invention relates to sausage slicing machines in general for salami and like products.

In particular, the invention relates to an automatic slicing machine of the type comprising a framework carrying an electric motor which drives an orbital blade and a feed device for continuously feeding a line of products to be sliced towards the path of displacement of the orbital blade.

In sausage slicing machines of this type there is a problem of feeding the products to be sliced towards the orbital blade in a regular and continuous manner so that the slices cut at each cutting cycle of the blade are as regular as possible and of constant thickness.

In a known slicing machine of the type mentioned above, the feed device comprises a plurality of continuous belt conveyors disposed in pairs on opposite sides of the products to be sliced and arranged to move and guide these until they are close to the path of displacement of the orbital blade.

This system, in addition to being complex and expensive both from the point of view of manufacture and maintenance, is unsatisfactory in that the two conveyors of each pair are not able effectively to support that portion of the corresponding product to be sliced which is adjacent the orbital blade. Indeed, the portion of the product projects from the ends of the two active runs of the two conveyors, and particularly in the case of products of low consistency such as salami, can give rise to irregularities and imperfections in the slices cut from time to time.

According to a further known solution, the feed device comprises a plurality of pushers arranged to press the products to be sliced progressively in the direction of the orbital blade.

This solution has similar disadvantages to those cited previously and is completely unsatisfactory when the products to be sliced have considerable axial dimensions and low consistency, as for example salami. Moreover, this solution does not allow completely continuous operation of the slicing machine.

The object of the present invention is to provide an automatic slicing machine of the type defined at the beginning in which the feed device is particularly simple, economical and functional and allows the disadvantages of the conventional devices cited above to be avoided.

SUMMARY OF THE INVENTION

According to the invention, this object is achieved by virtue of the fact that the feed device comprises a plurality of entrainment shafts located side by side and separted from each other by means of longitudinal containment partitions, each entrainment shaft having a helical projection on which a respective product to be sliced rests in use, the product being inserted between a corresponding pair of containment partitions, and means for effecting rotation of the entrainment shafts simultaneously in synchronism with the movement of the orbital blade.

By virtue of this characteristic, the products to be sliced may be impelled continuously towards the orbital blade, while resting on the entrainment shafts until they are at a very small distance from the path of displacement of the blade itself. Indeed the entrainment shafts may extend, without difficulty, immediately adjacent the cutting zone, reducing the portions of products to be cut projecting towards the cutting blade to a minimum and hence ensuring that regular slices of constant thickness are obtained in practice.

In order to achieve an efficient entrainment action on the products to be sliced, the helical projections preferably have the form of screw threading having a substantially triangular profile with rounded crests. In this case the ratio between the pitch and the height of the threading is normally greater than one and preferably between 3 and 4. Thus, it is possible to obtain a high specific pressure in the contact zone between the crests of the turns of the threading and the product to be sliced thereby avoiding risks of sliding.

According to a preferred characteristic of the invention, the entrainment shafts are driven by means of the same electric motor that drives the orbital blade.

This characteristic allows a considerable constructional simplicity to be achieved for the slicer together with a reduction in the operating costs.

An adjustable presser is preferably provided above the end of each entrainment shaft and arranged to exert a slight pressure on the surface of the product to be sliced in the zone immediately preceding the cutting zone.

The presence of these pressers, the position of which may be varied in dependence on the transverse dimensions of the products to be sliced, allows rotation of the products themselves relative to the entrainment to be prevented, thus ensuring correct translational movement towards the orbital blade.

In a preferred embodiment of the invention, the entrainment shafts are supported by the framework in a readily dismountable manner.

This characteristic allows cleaning and maintenance of the entrainment shafts to be carried out periodically by particularly simple, easy and rapid operations, thus limiting dead times for the slicer.

BRIEF DESCRIPTION OF THE DRAWINGS

Further characteristics and advantages of the invention will becomes clear in the course of the detailed description which follows, with reference to the appended drawings provided purely by way of nonlimiting example, in which.

DETAILED DESCRIPTION

Figure 1:
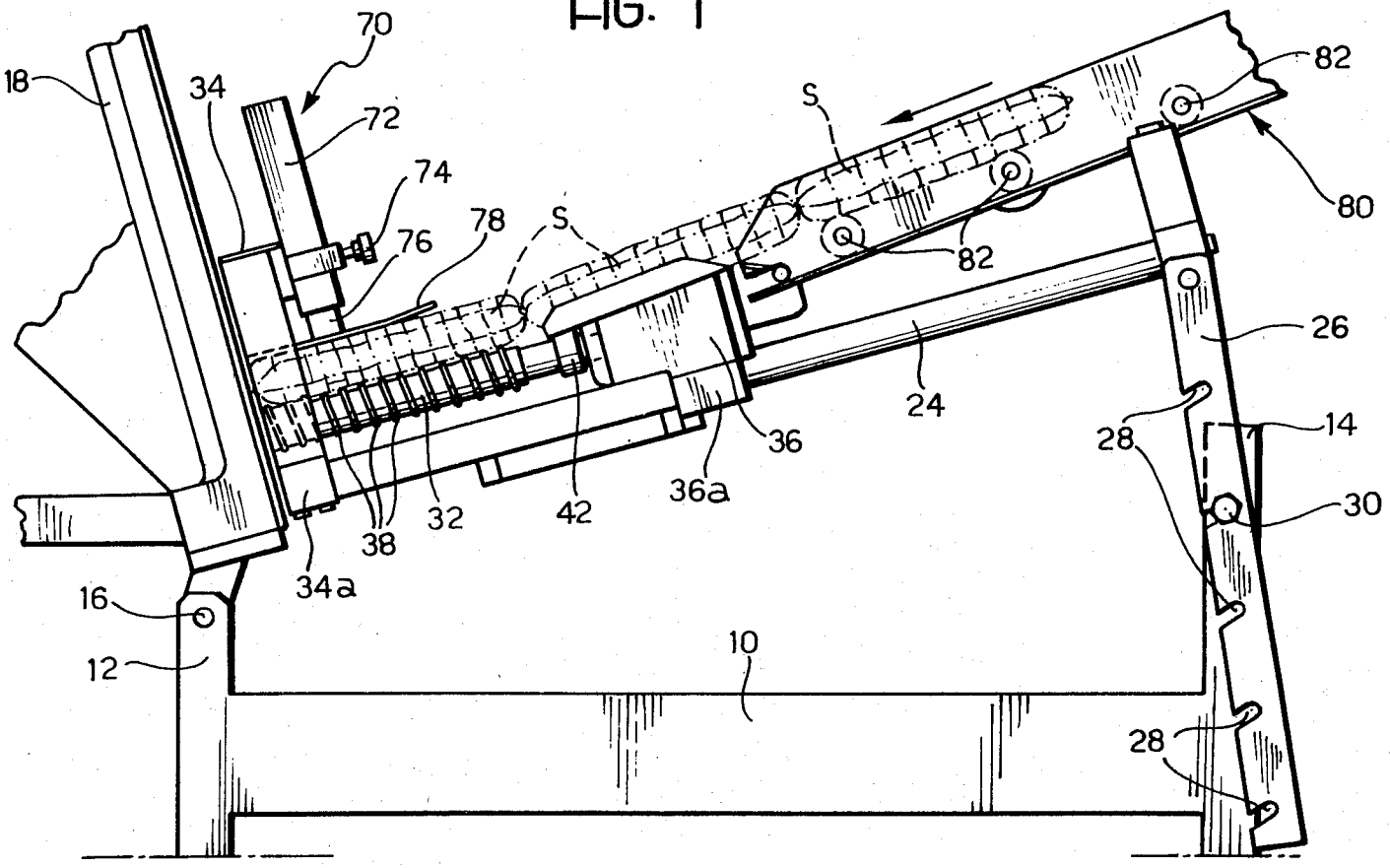
FIG. 1 is a schematic and partial view side elevation of a sausage slicing machine according to the invention.
Figure 2:
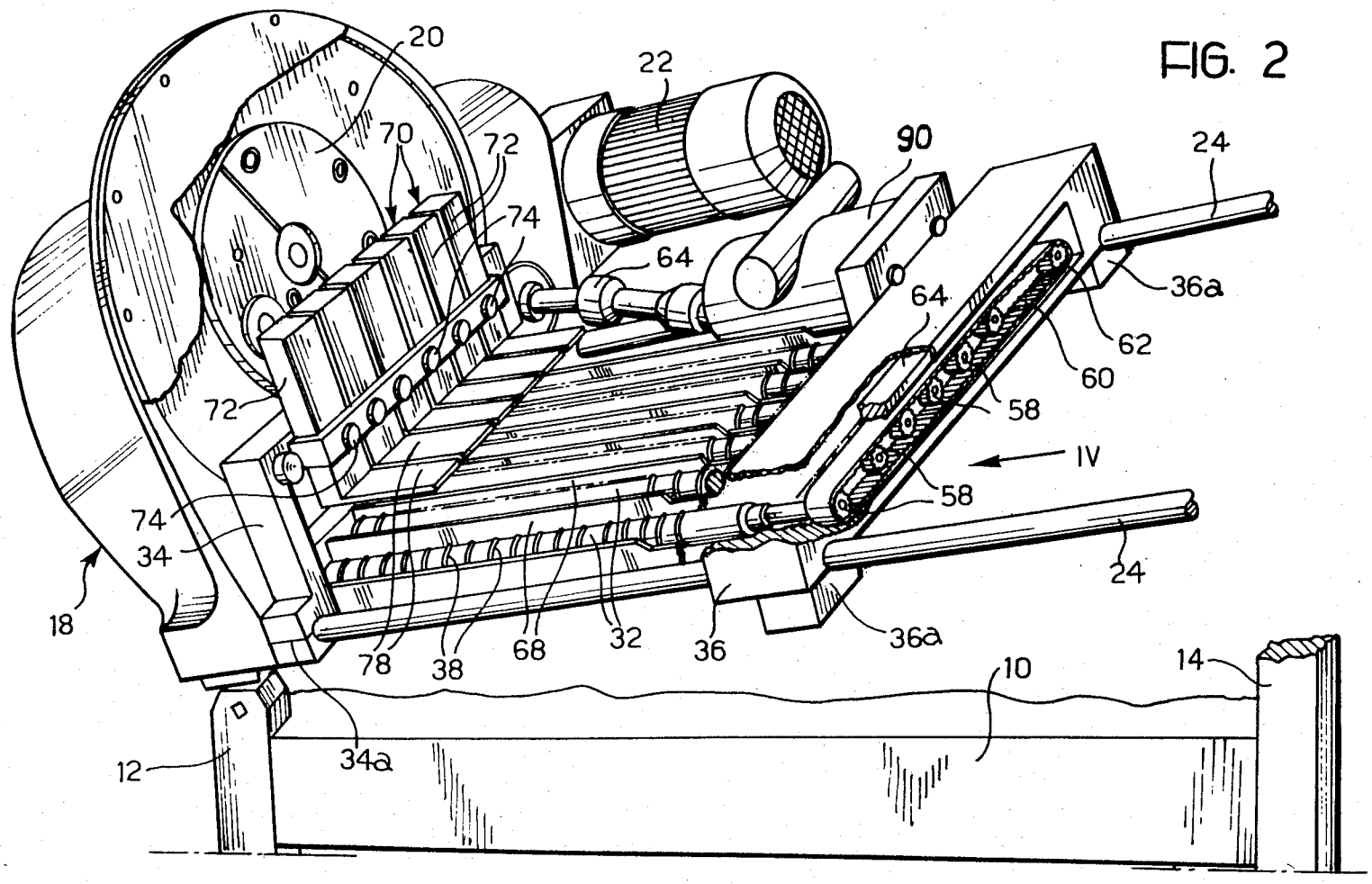
FIG. 2 is a schematic perspective view, partially cut-away of the sausage slicing machine.

Referring initially to FIGS. 1 and 2, the sausage slicing machine according to the invention includes a support framework, part of which is schematically shown at 10, provided with two pairs of upwardly projecting vertical, spaced apart pillars, the front pair being 12 and the rear pair 14.

To the front pillars 12 there is articulated, about transverse pins 16, a cutting unit 18 including, in known manner, an orbital blade 20 driven by an electric motor 22.

To the lower part of the cutting unit 18 there are connected two cylindrical guide rods 24 extending perpendicular to this cutting unit 18 towards the rear pillars 14. To the ends of the two guide rods 24 opposite the cutting unit 18 there are articulated two support elements 26 each of which is provided with a series of notches 28 arranged to engage selectively a pin 30 carried by a respective rear pillar 14. Thus it is possible to adjust the position of the two guide rods 24 between a condition of minimum inclination, corresponding to the engagement of the pins 30 in the upper notches 28, and a condition of maximum inclination corresponding to the engagement of these pins 30 in the lower notches 28 of the support elements 26.

A plurality of parallel entrainment shafts 32 are disposed in a row above the two guide rods 24 and extend from the cutting unit 18 to about the middle of the guide rods 24. The entrainment shafts 32 are rotatably supported at one end by a first support part generally indicated as 34 adjacent the cutting unit 18 and at the other end by a second support part 36. Both the support parts 34, 36 are provided underneath with tubular attachment members **34*a*, 36*a* connected to the two guide rods 24**.

Figure 3:
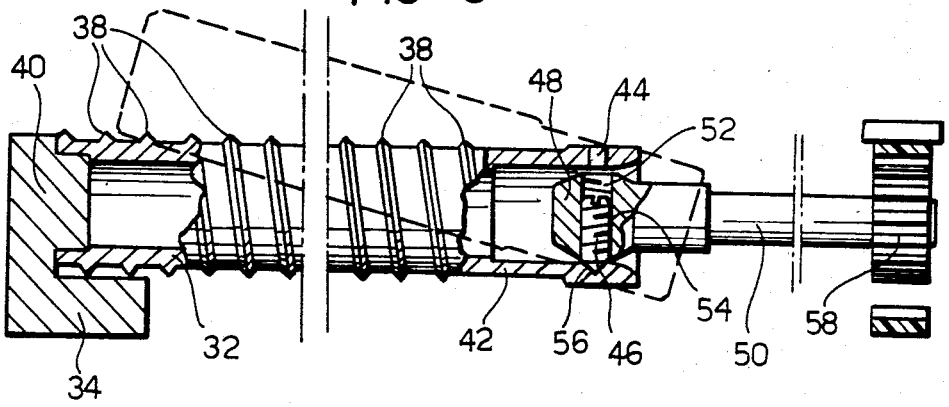
FIG. 3 is a partial longitudinal section, on an enlarged scale, of a detail of FIGS. 1 and 2.
Figure 5:
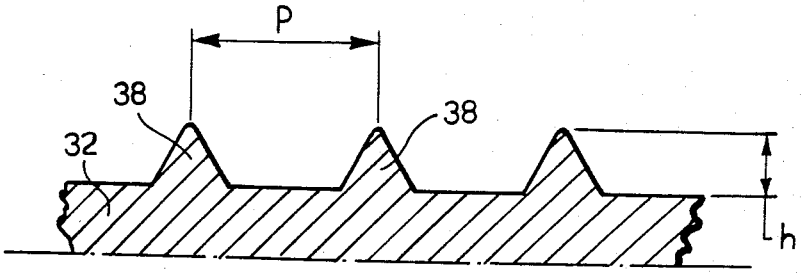
FIG. 5 illustrates a detail of FIGS. 1 to 3 on an enlarged scale.

As illustrated in detail in FIGS. 3 and 5, each of the entrainment shafts 32 is constituted by a hollow, elongate cylindrical body having a helical projection 38 on its outer surface in the form of threading with a profile of an isosceles triangle with a slightly rounded crest. In the example illustrated each entrainment shaft 32 has an outer diameter of about 40 mm and the threading has a height h of 3 mm and a pitch p of 10 mm.

In the front end of each entrainment shaft 32 there is rotatably engaged, and axially removable, a cylindrical support projection 40 carried by the support part 34. The opposite end of the shaft 32 has an axial cylindrical tang 42 provided close to its free end with a radial through hole 44 and a conical internal notch 46 diametrally opposite the hole 44. A substantially spherical head 48 is engaged with very slight clearance in the tang 42, the head being fixed to one end of a drive shaft 50 which extends as an elongation of the entrainment shaft 32 and is rotatably supported by the support plate 36. The spherical head 48 is formed with a transverse screw threaded through hole 52 in which is screwed a stop dowel 54 having a conical end 56 which engages in the notch 46 of the shaft 32. This assembly allows the entrainment shaft 32 to be disengaged and removed easily and rapidly from the drive shaft 50 to allow periodic cleaning to be carried out. To remove the shaft to unscrew the stop dowel 54 may be unscrewed from the screw threaded hole 52 by passing a suitable tool through the aperture 44 of the shaft 32 until the point 56 is disengaged from the notch 46. At this point the shaft 32 may be displaced axially on the opposite side from the cutting unit 18 to disengage the front end from its support projection 40. The shaft 32 is then raised in the manner illustrated in broken lines in FIG. 3 and withdrawn from the spherical head 48 of the drive shaft 50.

Figure 4:
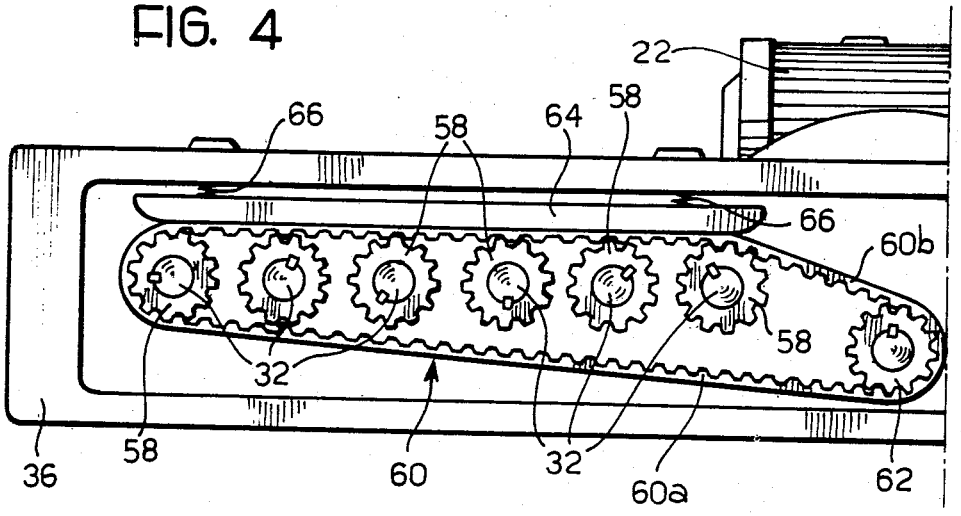
FIG. 4 is a schematic front view taken on arrow IV of FIG. 2.

To the end of each drive shaft 50 opposite the head 48 is keyed a pinion or sprocket 58. As illustrated clearly in FIG. 4, the toothed sprockets 58 associated with the various drive shafts 50 are side by side and disposed at the same level within the support part 36.

An endless toothed drive belt indicated 60 passes over a drive pinion or sprocket 62 which is driven through a transmission assembly generally indicated 64 and a speed variator 90 by an electric motor 22 which drives the orbital blade 20. The drive sprocket 62 is located to the side and beneath the series of sprockets 58 so that the lower pass of the drive belt 60, indicated **60*a*, connects the drive sprocket 62 to the sprocket 58 connected to the entrainment shaft 32 furthest from this sprocket 62 without interfering with the intermediate sprockets 58**.

The upper pass **60*b* of the drive belt 60 is, however, kept in engagement with all the sprockets 58 by the action of a presser 64 constituted by a plate resiliently pressed towards these sprockets 58 by a pair of helical compression springs 66**.

A plurality of longitudinal containment partitions interposed between each entrainment shaft 32 and the adjacent shaft are indicated by 68. The containment partitions 68 are releasably supported at their ends for reasons which will be clarified below by the support part 34 and by the support part 36 respectively.

A plurality of adjustable pressers 70 are carried by the support part 34 and disposed above the ends of the entrainment shafts 32 facing the cutting unit 18. Each of the pressers 70 comprises a casing 72 vertically displaceable relative to the support part 34 and lockable relative thereto by means of a screw stop member 74 and an element 76 slidably mounted in the casing 72 against the action of a compression spring, not shown in the drawings, and carrying beneath it a pressure plate 78 arranged parallel to the respective entrainment shaft 32.

The sausage slicing machine according to the invention further includes a feed conveyor 80 supported by the framework 10 behind the row of entrainment shafts 32 with one end connected to the support part 36. The conveyor 80, which has a plurality of transverse, rotatable rollers 82, is inclined downwardly towards the entrainment shafts 32 and allows the products to be sliced to be transferred continuously thereto.

The machine according to the invention may also be provided with a removable guard, not shown in the drawings, which can be fixed above the entrainment shafts 32.

OPERATION

The products to be sliced, for example salami S, are transferred successively and continuously from the conveyor 80 to the different entrainment shafts 32. By means of the rotation of these shafts 32 effected by means of the electric motor 22 in the manner described above, the salami S are progressively thrust towards the cutting unit 18 due to the effect of the action of the helical projections 38. The particular conformation of these latter allows a high specific pressure to be achieved in the zone of contact with the salami S and ensures a correct entrainment action, avoiding risks of sliding. On the other hand, the salami S are prevented from rotating by virtue of their lateral bearing against the longitudinal containment partitions 68 and the contact with the plates 78 of the pressers 70. As stated above, the longitudinal containment partitions 68 may be removed, to allow the conveyance of salami S of large sizes and pressers 70 are adjustable in height in dependence on the transverse dimensions of the salami.

Due to the progressive advancement of the salami S towards the cutting unit 18 and the orbital movement of the blade 20, slices of constant thickness are cut simultaneously from the salami S in the line. Given the particular conformation of the entrainment shafts 32, the salami S are supported effectively up to a very short distance from the path of displacement of the orbital blade 20, thus ensuring correct and regular cutting of the slices.

The thickness of the slices cut may clearly be varied by acting on the speed variator 90.

Naturally, the principle of the invention remaining the same, the details of construction and the embodiments may be varied widely with respect to that described and illustrated without thereby departing from the scope of the present invention.

I claim:

1. Automatic sausage slicing machine for salami and the like products, of the type comprising a framework, an orbital blade, an electric motor drivingly connected to the orbital blade, and a feed device for feeding a line of products to be sliced continuously towards the path of displacement of the orbital blade, wherein the improvement consists in the feed device comprising:

a plurality of entrainment shafts located side by side and extending towards the orbital blade;

a plurality of longitudinal containment partitions separating neighboring entrainment shafts;

each entrainment shaft having a helical projection on which a respective product to be sliced rests in use of the machine, said product being inserted between a pair of correponding said containment partitions;

means for simultaneously rotating the said entrainment shafts in synchronism with the movement of the orbital blade said means for rotating the entrainment shafts being the electric motor which drives the orbital blade;

a sprocket mounted on the end of each entrainment shaft opposite the orbital blade, an endless toothed drive belt engaging said sprocket, and a transmission including a speed variator drivingly connected to said drive belt, the transmission being driven by the electric motor;

presser means for retaining the active pass of the drive belt in engagement with the corresponding zones of said sprockets, and means for maintaining the inactive pass of the drive belt spaced from the said sprockets; and a drive sprocket driven by the transmission means, the drive belt passing over said drive sprocket, which is disposed at a level different from that of the sprockets carried by the entrainment shafts, whereby the inactive pass of the drive belt between the said drive sprocket and the sprocket associated with the entrainment shaft furthest from the drive sprocket does not interfere with the remaining entrainment shaft sprockets and further including a plate acting on the active pass of the drive belt, and means pressing said plate resiliently towards the entrainment shaft sprockets.

2. Sausage slicing machine as defined in claim 1, wherein the helical projections are in the form of screw threading having a substantially triangular profile and a slightly rounded crest.

3. Sausage slicing machine as defined in claim 2, wherein the ratio between the pitch and the height of the screw threading is substantially greater than 1, and preferably between 3 and 4.

4. Sausage slicing machine as defined in claim 1 wherein the entrainment shafts are inclined downwardly towards the path of displacement of the orbital blade.

5. Sausage slicing machine as defined in claim 4, including means for adjusting the inclination of the entrainment shafts.

6. Sausage slicing machine as defined in claim 1, wherein, above the ends of each entrainment shaft facing the orbital blade, an adjustable presser is arranged to exert a slight pressure against the surface of the product to be sliced in the zone immediately preceding the cutting zone of the orbital blade.

7. Sausage slicing machine as defined in claim 1, wherein the said longitudinal containment partitions are rapidly releasable.

8. Automatice sausage slicing machine for salami and the like products, of the type comprising a framework, an orbital blade, and a feed device for feeding a line of products to be sliced continuously towards the path of displacement of the orbital blade, wherein the improvement consists in the feed device comprising:

a plurality of entrainment shafts located side be side and extending towards the orbital blade, said entrainment shafts being supported by the framework in a rapidly releasable manner and being provided with opposite hollow ends and a series of cylindrical projections supported on the framework adjacent the path of displacement of the orbital blade on each of which projections one of the hollow ends of a respective entrainment shaft is engaged for rotation and sliding movement, and including a drive shaft having at one end a substantially spherical head removably engaged in the other hollow end of each entrainment shaft, said drive shaft having one of said entrainment shaft sprockets keyed on its opposite end, the substantially spherical head having a screw threaded through hole in which a stop dowel is screwed, the stop dowel having one end arranged to engage a coupling recess in the entrainment shaft the other end of the stop dowel being screw-adjustable from the outside through a radial hole in the wall of the entrainment shaft on the side diametrally opposite said coupling recess;

a plurality of longitudinal containment partitions separting neighboring entrainment shafts, each entrainment shaft having a helical projection on which a respective product to be sliced rests in use of the machine, said product being inserted between a pair of corresponding said containment partitions; and means for simultaneously rotating the said entrainment shafts in synchronism with the movement of the orbital blade.

9. Sausage slicing machine as defined in claim 8, wherein the helical projections are in the form of screw threading having a substantially triangular profile and a slightly rounded crest.

10. Sausage slicing machine as defined in claim 9, wherein the ratio between the pitch and the height of the screw threading is substantially greater than 1, and preferably between 3 and 4.

11. Sausage slicing machine as defined in claim 8, wherein the entrainment shafts are inclined downwardly towards the path of displacement of the orbital blade.

12. Sausage slicing machine as defined in claim 11, including means for adjusting the inclination of the entrainment shafts.

13. Sausage slicing machine as defined in claim 8, wherein, above the ends of each entrainment shaft facing the orbital blade, an adjustable presser is arranged to exert a slight pressure against the surface of the product to be sliced in the zone immediately preceding the cutting zone of the orbital blade.

* * * * *